United States Patent [19]

Kasama et al.

[11] Patent Number: 4,527,292

[45] Date of Patent: Jul. 9, 1985

[54] LOCKING MEANS FOR A FIXING BAND OF A DIVING MASK

[75] Inventors: Masatoshi Kasama, Chiba; Kohzo Nakai, Sarumachi, both of Japan

[73] Assignee: Kinugawa Pacific Kabushiki Kaisha, Japan

[21] Appl. No.: 500,925

[22] Filed: Jun. 3, 1983

[51] Int. Cl.[3] ..... A61F 9/02

[52] U.S. Cl. ..... 2/452; 2/426; 24/313; 24/323

[58] Field of Search ..... 2/452, 426, 427, 428, 2/421, 440, 437, 448, 449, 450; 24/181, 190, 194, 573, 313, 17 AP, 30.5 L

[56] References Cited

U.S. PATENT DOCUMENTS

| | | | |
|---|---|---|---|
| 2,979,794 | 4/1961 | De Bartolo | 24/17 AP |
| 3,309,742 | 3/1967 | Chin | 24/30.5 L |
| 3,605,204 | 9/1971 | Amundsen | 2/452 X |
| 3,606,648 | 9/1971 | Schuler | 2/452 X |
| 4,282,634 | 8/1981 | Krauss | 24/313 X |
| 4,287,644 | 9/1981 | Durand | 24/17 AP |
| 4,290,673 | 9/1981 | Yamamoto | 2/437 X |

*Primary Examiner*—Werner H. Schroeder
*Assistant Examiner*—J. L. Kravitz
*Attorney, Agent, or Firm*—Lowe, King, Price & Becker

[57] ABSTRACT

A locking means for a fixing band of diving mask which can fasten or release the fixing band as a fastening member to which one end of the fixing band is connected is inserted into or removed from a mask frame by one action. The locking means comprises two main portions: holders provided at the both sides of a mask frame integrally formed with a face fitting member of the diving mask, and fastening member formed in a taper shape, having three triangle pawls integrally formed with the fastening member. The three triangle pawls are so arranged as to become higher in order, so that the fastening member be gradually tightened owing to the triangle pawls as the fastening member is moved forwards. The locking means in accordance with this invention is particularly useful in a fixing band of a diving mask.

2 Claims, 11 Drawing Figures

LOCKING MEANS FOR A FIXING BAND OF A DIVING MASK

BACKGROUND OF THE INVENTION

1. Field of the Invention

The present invention generally relates to a diving mask. More particularly, the present invention relates to a locking means for releasably fastening the fixing band of a diving mask, to which one end of the fixing band, is connected by insertion at its ends into the diving mask frame in one action.

2. Description of the Prior Art

In conventional diving masks, a chrome-steel fastening member is inserted into a holder provided at the side surface of a mask frame and placed in its locking condition thereby, and a portion of a fixing band is connected to the fastening member. Thus, the end portion of the fixing band may become entangled with seaweeds or knock against bars or pickets during diving, which can result in serious trouble. Furthermore, the manufacturing cost of such a fastening member per se is relatively high.

SUMMARY OF THE INVENTION

With these problems in mind, therefore, it is the primary object of the present invention to provide a locking means for a fixing band of a diving mask which can provide a fastening member manufactured at low cost. The fastening member is housed in the mask frame of the mask so as to protect the fastening member from damage and from entanglement with seaweeds.

Another object of the present invention is to provide a locking means for a fixing band of a diving mask which is designed so that the fixing band can be fastened or unfastened in one action.

As will be apparent to persons skilled in the art, the apparatus of the present invention may also be used with face masks for other purposes, e.g., for skiers, machinists and the like.

To achieve these objects, the locking means according to the present invention comprises holders, provided at both side surfaces of a mask frame integrally formed with a face fitting member, and fastening members each formed in a tapered shape for connecting to a fixing band which at it ends can be insertedly housed in each of the holders.

BRIEF DESCRIPTION OF THE DRAWINGS

The features and advantages of the locking means for a fixing band of a diving mask according to the present invention, over the prior-art locking devices or means, will be more clearly appreciated from the following description of the preferred embodiments of the invention, taken in conjunction with the accompanying drawings in which like reference numerals designate the same or similar elements or sections throughout the figures thereof.

DETAILED DESCRIPTION OF THE PREFERRED EMBODIMENTS

Figure 1:
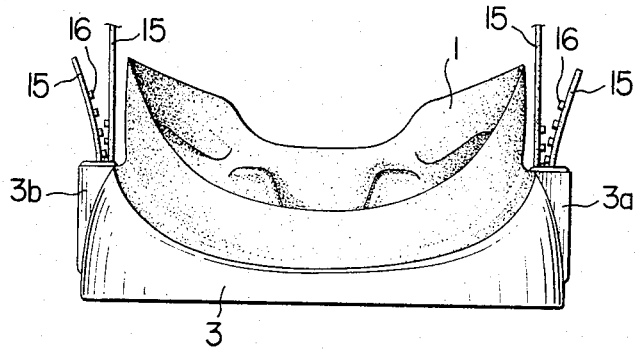
FIG. 1 is a plan view showing essential parts of a diving mask which employs the present invention.
Figure 2:
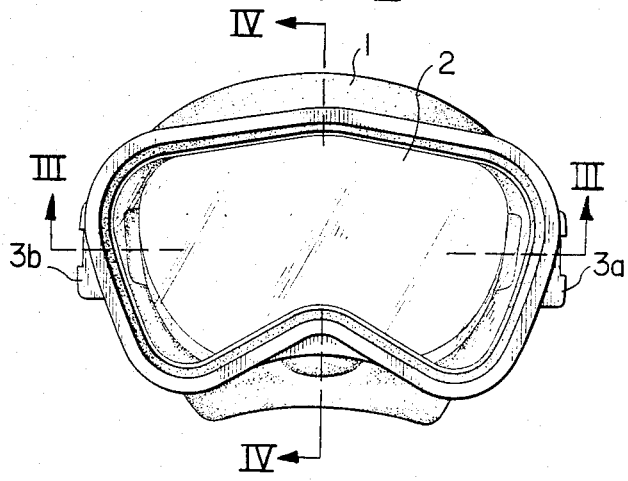
FIG. 2 is an elevational view of the diving mask of FIG. 1.

Hereinafter, an embodiment of the present invention will be explained with reference to the accompanying drawings.

Referring to FIGS. 1 to 5, there is shown a diving mask in which an embodiment of the present invention is employed. In the drawings, the reference numeral 1 denotes a face fitting member made of synthetic resin, rubber or the like. The most forward end of the face fitting member 1 (corresponding to the top end in FIG. 3, or the right end in FIG. 4) is formed to have a recessed groove 1*a* having a channel shape section. A strong and transparent glass plate 2 is fitted and fixed therein. A mask frame 3 is integrally fitted on the outer surface of the face fitting member 1 along the fringe of the glass plate 2 held therein. The mask frame 3 is integrally formed, with holders 3*a* and 3*b* substantially at the center of the two side surfaces (left and right) thereof. Hereinafter, the explanation will focus on only the holder 3*a* because the holder 3*b* is constructed in the same manner. Thus, the reference numerals of the holder 3*a* shall also denote the corresponding parts of the holder 3*b*.

Figure 3:
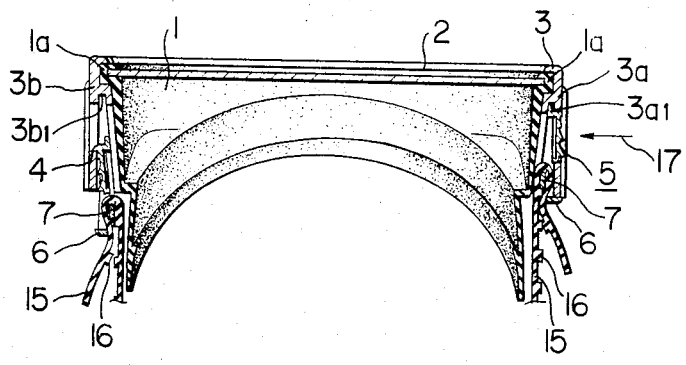
FIG. 3 is a sectional view taken along the line III—III in FIG. 2 showing the fastened condition of the fixing band at the right side of the figure and the unfastened condition of the fixing band at the left side therein, respectively.
Figure 4:
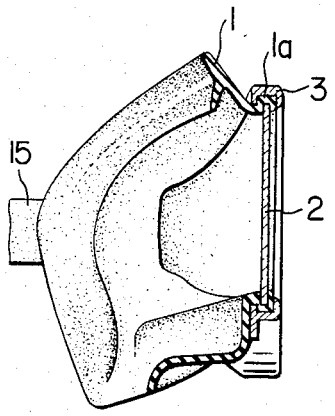
FIG. 4 is a sectional view taken along the line IV—IV in FIG. 2.
Figure 9:
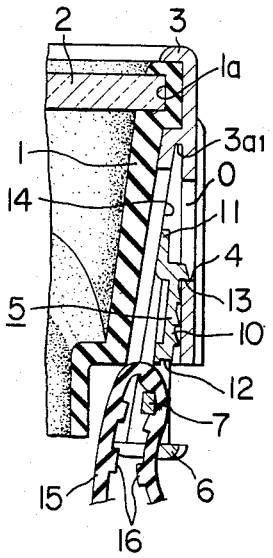
FIGS. 9 to 11 show steps in the process of moving the fastening member with the fixing band of the diving mask to fasten the fixing band in the holder.
Figure 10:
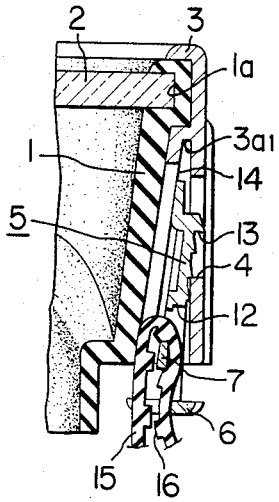
Figure 11:
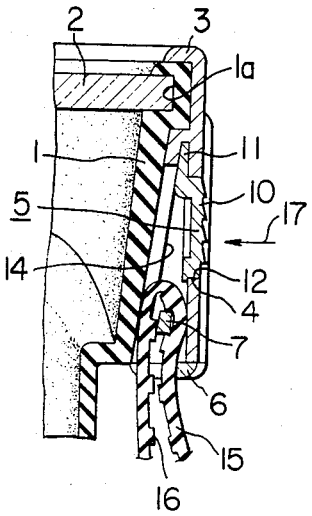

The holder 3*a* seen most clearly in FIGS. 9–11 is formed in the shape of a housing which is constructed in such manner that a recessed end $3a_1$ is formed in the most front end of the inside thereof and an opening O, having a rectangular shape, formed substantially at the center in the outer side surface of the holder 3*a*. This is shown most clearly in FIGS. 5 and 9. Further, the interior space of the holder 3*a* tapers off toward the front end as shown in FIG. 3.

Figure 6:
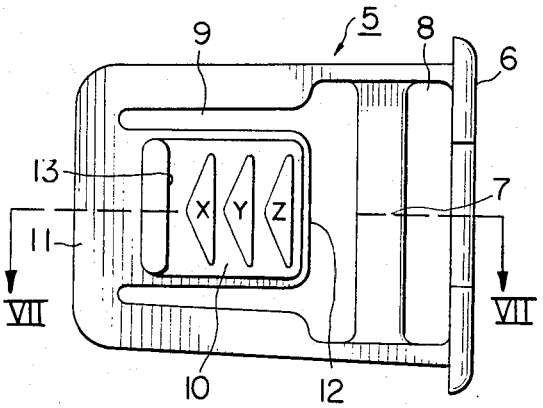
FIG. 6 is a side elevational view showing the fastening member.
Figure 7:
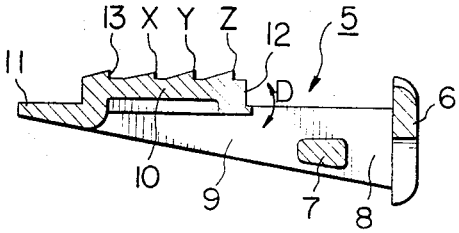
FIG. 7 is a sectional view taken along the line VII—VII in FIG. 6.
Figure 8:
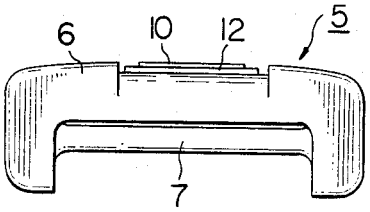
FIG. 8 is an end elevational view showing the fastening members of FIG. 6.

Referring to FIG. 6, there is shown an embodiment of a fastening member 5 which can fit into the holder 3*a*. The fastening member 5 is made of synthetic resin so as to be highly flexible. The detailed configuration of the fastening member 5 is shown in FIGS. 6 to 8. That is, the rear end 6 (shaped as a pawl at the right end in FIGS. 6 and 7) of the fastening member 5 comprises a band bar 7, a locking member 10 and a tongue 11. There is a rectangular space 8, defined between the end pawl 6 and the band bar 7, and a substantially U-shaped space 9 defined between the band bar 7 and the locking member 10, as shown in FIG. 6.

Figure 5:
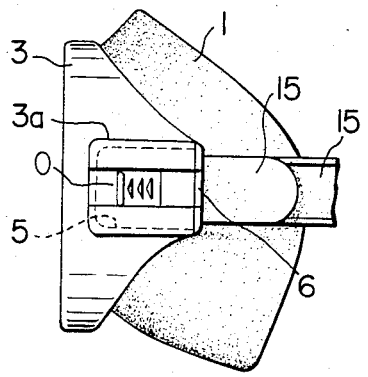
FIG. 5 is a side view showing the right side of FIG. 2.

The overall shape of the fastening member 5 is so tapered as to be similar to the internally tapered shape of the holder 3*a* as shown in FIG. 7. Thus, the tongue 11 of the fastening member 5 can fit the recessed end $3a_1$ of the holder 3*a*, and the locking member 10 can engage with the rectangular opening O when the fastening member 5 is completely inserted in the holder 3*a*. The length of the fastening member 5 is shorter than that of the holder 3*a*, so that the fastening member 5 can be covered with the holder 3*a* except for the end pawl 6, as shown in FIG. 5. The locking member 10 is fixed only at the front end thereof, so that the locking member 10 can move like a plate spring as indicated by the direction of arrow D shown in FIG. 7. Further, the locking member 10 is formed with a front projection 13, three triangle pawls X, Y, and Z and a rear edge 12, as best shown in FIG. 6. The three triangle pawls X, Y and Z are so arranged as to become higher in this order, as shown in FIGS. 7, 9, 10 and 11, so that the fastening member 5 is threreby gradually tightened as it is moved forward.

A fixing band 15 is formed with a plurality of projections 16 at regular intervals on one side surface in the vicinity of each end thereof, as best shown in FIGS. 9–11. The fixing band 15 is so wound around the bar 7 as to engage the projections 16 in order to prevent the fixing band 15 from slipping off the bar 7.

The operation of the locking means, constructed as described above, will be explained as follows, and is best understood by reference to FIGS. 3 and 9–11. The fastening member 5 connected to the fixing band 15 is inserted in the holder 3*a* so that the front projection 13 engages with a holding edge 4 of the opening O. This state is shown by the left side holder 3*a* as shown in FIGS. 3 and 9. Further, as the fastening member 5 is moved forwards (towards the glass plate 2), the pawls X, Y and Z engage with the holding edge 4, each clicking more audibly in this order. The fastening member 5 is gradually tightened owing to the triangle pawls X, Y and Z as the fastening member 5 is moved forwards. Finally, when the tongue 11 of the fastening member 5 contacts the recessed end $3a_1$ of the holder 3*a*, the rear edge 12 of the locking member 10 engages with the holding edge 4 and the end pawl 6 contacts the end of the holder 3*a*. This locked state is shown in the right side holder 3*b* in FIGS. 3, 5 and 9. In this locked state, the fastening member 5 is completely housed in the holder 3*a* (likewise 3*b* on the other side) and the fixing band 15 is kept fastened within the holder 3*a*. The triangle pawls X, Y and Z of the locking member 10 appear invisible through the opening O of the holder 3*a*.

In order to unlock the fastening member 5 from the holder 3*a*, the locking member 10 is depressed as indicated by the arrow 17 shown in FIG. 3. The rear edge 12 of the locking member 10 is released from the engagement with the holding edge 4 of the opening O in an instant. The fastening member 5 is moved backwards and the front projection 13 engages with the holding edge 4 of the opening O as shown in the left side holder 3*a* in FIG. 3. According to this engagement between the front projection 13 and the holding edge 4, it is possible to prevent the fastening member 5 from unnecessarily slipping out of the holder 3*a*. Then the fastening member 5 can be smoothly released from the holder 3*a* by depressing the front projection 13.

In addition to the above explanations, FIGS. 9 to 11 show the successive steps in engaging the fastening member, with the fixing band of the diving mask mask, in the holder to be fastened. In this process, the fastening member is gradually tightened owing to the triangle pawls as the fastening member is moved forward because the three triangle pawls X, Y and Z are so arranged as to become higher in this order. In FIG. 9, although the front projection is engaging with the holding edge 4, the first pawl X has not yet been engaged with the holding edge 4, so that it is possible to adjust the fixing band in that status. In the status shown in FIG. 10, it is more difficult to adjust the fixing band. Finally, in the status as shown in FIG. 11, the fixing band is completely fastened, and cannot be pulled out from the fastening member and diving mask.

As explained above, the locking means for the fixing band of diving mask comprises holders provided at both side surfaces of the mask frame, and fastening members, each formed in a tapered shape like a fan slightly unfolded, for connecting to the fixing band, which can be insertedly housed in each of the two holders. The fastening member connected to the fixing band near each of its ends is so designed as to be covered by the holder when the fastening member is fully inserted into each of the holders. Accordingly, the fastening member can be free from damage due to knocking against objects such as bars, and will be free of entanglement with seaweeds while the diving mask is used in the sea. Furthermore, the fastening member except for the end pawl is completely covered by the holder so that the overall appearance of the diving mask will be improved. Accordingly, the triangle pawls formed on the fastening member, appearing through the rectangular opening of the holder, not only assist the fastening function but also improve the design. The interiors of the holders, like the fastening members, are tapered in shapes to match each other so that the engagement and disengagement therebetween can be smoothly and exactly carried out. That is, the fixing band can be completely fastened or released by one action. Since the fastening member is made of synthetic resin, it can be manufactured at a lower cost in comparison with one made of chrome-steel. Also, a fastening member made of synthetic resin is not heavy and fits to the fixing band so that the fastening member does not slip off from the fixing band even when the fastening member is kept unlocked with respect to the holder.

It is further to be understood by those skilled in the art that the foregoing description is only of a preferred embodiment of the present invention and that various changes and modifications may be made without departing from the spirit and scope thereof.

What is claimed is:

1. A locking means for a fixing band of a diving mask, comprising:

two holders, one located at each of two sides of said diving mask, each of said holders having a generally forwardly tapering inside shape formed between a flat inner surface and a flat outer surface at an acute angle therewith, each of said holders having a first generally rectangular aperture at the wider end of said tapered inside shape, and a second generally rectangular aperture in said flat outer surface of said tapered inside shape, respectively;

fastening members, each formed in a generally forwardly tapered shape to fit into said forwardly tapered inside shape of said holders when pressed therein;

integral with each of said fastening members, an end pawl, a generally rectangular opening adjacent said end pawl, a band bar adjacent said rectangular opening, a generally U-shaped opening on another side of said band bar, surrounded on a substantial portion of its periphery by said U-shaped opening, a generally rectangular springy locking member attached to the thin end of said tapered fastening member, the outside surface of said locking member being provided with a plurality of triangular pawls and a front projection respectively; and a flexible fixing band, formed with a plurality of transverse projections on one side thereof, uniformly spaced to be apart by a distance not less than the width of said band bar.

2. A locking means as set forth in claim 1, wherein: said triangular pawls have their bases parallel to said band bar and the respective pawl heights, with respect to said fastening member surface that makes substantial contact with said flat inner surface of a holder, increase with the proximity of each of said triangular pawls with respect to said band bar, whereby progressive insertion of said fastening member into said holder causes said fixing band to be held therein by said band bar with commensurately progressive firmness.

* * * * *